United States Patent [19]

Cohen

[11] Patent Number: 4,758,976

[45] Date of Patent: Jul. 19, 1988

[54] HIGH BANDWIDTH TRIPLE PRODUCT PROCESSOR USING A SHEARING INTERFEROMETER

[75] Inventor: Jonathan D. Cohen, Hanover, Md.

[73] Assignee: The United States Government as represented by the Director of the National Security Agency, Washington, D.C.

[21] Appl. No.: 909,050

[22] Filed: Sep. 16, 1986

[51] Int. Cl.[4] ..... G06G 7/16

[52] U.S. Cl. ..... 364/837; 364/841; 364/822

[58] Field of Search ..... 364/822, 841, 827, 837, 364/845; 350/162.11, 162.12

[56] References Cited

U.S. PATENT DOCUMENTS

| | | | |
|---|---|---|---|
| 4,225,938 | 9/1980 | Turpin | 364/822 |
| 4,365,310 | 12/1982 | Green | 364/837 |
| 4,607,344 | 8/1986 | Athale | 364/822 |
| 4,633,428 | 12/1986 | Byron | 364/845 |
| 4,686,646 | 8/1987 | Goutzoulis | 364/845 |

OTHER PUBLICATIONS

Cohen, Jonathan D. "High Bandwidth Triple Product Processor Using a Shearing Interferometer," *Applied Optics,* vol. 24, Oct. 1, 1985, pp. 3173–3178.

Krainak, Michael A. and Brown, Douglas E. "Interferometric Triple Product Processor (almost common path)," *Applied Optics, vol. 24, May 1, 1985, pp. 1385–1388.*

Kellman, Peter *Time Integrating Optical Signal Processing* Diss. Stanford Univ., Jun. 1979, pp. 1–77.

*Primary Examiner*—Michael R. Fleming

*Attorney, Agent, or Firm*—John R. Utermohle; Thomas O. Maser

[57] ABSTRACT

An apparatus is described which performs optical processing on electrical signals to calculate the triple product integral in a manner which accommodates high bandwidth signals, which processes were formerly possible only in mechanically unstable designs.

14 Claims, 5 Drawing Sheets

HIGH BANDWIDTH TRIPLE PRODUCT PROCESSOR USING A SHEARING INTERFEROMETER

BACKGROUND OF THE INVENTION

1. Field of Invention

My invention relates to the field of optics, and more particularly to real time processing of optical signals with light.

2. Brief Description of the Prior Art

Real time optical signal processing technology began to develop at least as early as 1946, with processors capable of forming Hilbert transform pairs and limited voice processing. Processors using acoustooptic modulators date back to at least 1948, as illustrated by U.S. Pat. No. 2,451,465 to Barney. Since that time, interest in optical signal processing has steadily increased, despite the appearance and maturing of digital technology.

Though digital processors offer flexibility presently not possible in optics, interest continues to be drawn to optical solutions for a variety of reasons. The foremost of these is input bandwidth. While digital operation is difficult above bandwidths of a few tens of megahertz and nearly impossible above one hundred megahertz, acoustooptic processors routinely process bandwidths from the low megahertz region to a gigahertz. Optical signal processors operate exceptionally fast, with outputs available milliseconds to less than a microsecond after the input process is complete. The parallelism achieved in optics is also advantageous. It is not uncommon to perform operations on more than $10^5$ data elements, and with no more components than it takes to operate on a few. Still another feature of optics is that many desirable operations naturally lend themselves to easy implementation. The most important of these is the Fourier transform, which occurs in an almost trivial way in the optical domain. Multiplication is performed trivially, as well. Since optical systems usually have few components, they are often superior to their digital counterparts in size, power consumption, cost, and reliability.

The triple product processor is probably the most versatile of optical signal processors. Accepting three functions of time, f(t), g(t), and h(t), as inputs, the processor produces the ensemble of outputs $$\{R(x,y) = \int_T f(t)g(t-x)h(t-y)dt,\ (x,y)\epsilon S\},$$

where T is an interval, and S is typically a rectangle. With appropriate choice of inputs, including both the signals to be processed and auxiliary functions, a variety of processing operations may be achieved. Illustrative examples may be found in P. Kellman, "Time Integrating Optical Signal Processing," doctoral dissertation, Stanford University, Stanford, Calif., June, 1970. Such operations include the ambiguity function and the raster-format transform.

Triple product processors employ acoustooptic modulators to achieve the required delays and use time-integrating detector arrays to generate the integrals. The first triple product processor (TPP), devised by Turpin (U.S. Pat. No. 4,225,938) for ambiguity function processing, was configured as a Mach-Zehnder interferometer. Each interferometer arm contained a pair of Bragg cells such that one arm comntributed the modulation $f_1(t)\ g(t-x)$ to the output plane, while the other contributed $f_2(t)\ h(t-y)$. The resulting interference term at the detector contained the desired product $f_1(t)\ f_2(t)\ g(t-x)\ h(t-y)$. It was also recognized that two of the modulators could be combined and driven by the product $f(t)=f_1(t)f_2(t)$, and that all of the modulators could be placed in one arm if desired. The drawback of such constructions was obvious: the large interferometer was extremely sensitive to relative movement of the components due to vibration and temperature changes and to thermal gradients in the air.

An incoherent-light TPP which avoided the sensitivity of the interferometer has been demonstrated. One of the many variants of the incoherent-light triple product processor found in the prior art is pictured in FIG. 1. In this scheme, light from a (coherent or incoherent) source 10 modulated by $f(t)\geqq 0$ passes through two Bragg cells 14 and 15 oriented orthogonally and driven by g(t) and h(t), respectively. Lenses 17 and 19 serve to identify horizontal position on the detector array 20 with position along cell 14, and lenses 22 and 24 map delay in cell 15 to vertical position on the array. As a result, the intensity seen at the detector is $$I(x,y,t)=f(t)g^2(t-x)h^2(t-y),$$

where the units for x and y are chosen so that the acoustic velocity is taken as unity. The detector array 20 integrates the intensity of the impinging light over an interval T and produces the outputs $$\{C(x,y) = \int_T f(t)g^2(t-x)h^2(t-y)dt,\ (x,y)\epsilon S\},$$

where S now represents the locations of the detector elements. For some applications, this incoherent correlation may be sufficient. In case the coherent integration is required, Kellman, supra has shown how to obtain outputs of the form $$\int_T f(t)g(t-x)h(t-y)dt$$

by introducing reference "tones" with the inputs and detecting the output appropriately.

The Kellman architecture possesses a bandwidth limitation not present in the coherent-light architecture described above. This limitation can be seen by making the following observations: The Fourier transform of the light diffracted by cell 14 appears in the plane of cell 15 as a function of the horizontal space coordinate. All of this light must fall within the acoustic beam of cell 15 to be diffracted. Thus, the extent of the transform must be less than the acoustic beam height in cell 15. As the input bandwidth is increased, this becomes impossible to satisfy: larger bandwidth demands a smaller transducer capacitance and a corresponding decrease in beam height. At optical wavelengths, an insufficient aperture is provided to accommodate the full time-bandwidth product available in cell 14 if cell 15 is designed for too large a bandwidth. A pratical bandwidth limit on the order of 150 l MHz results.

If one wishes to obtain high bandwidth without returning to the instability of the Mach-Zehnder implementation, another architecture is required. One such architecture uses a construction similar to the incoherent-light TPP. Said architecture is described in M. A. Krainak and D. E. Brown, "Interferometric Triple Product Processor (Almost Common Path)," *Applied Optics*, 24, No. 9, May 1, 1985, pp. 1385–1388. The light source is replaced by a coherent source modulated by f(t). Bragg cell 15 is translated horizontally so that the light not diffracted by the first AO cell 14 is used to illuminate the second cell, with the diffracted light passing next to it. When, on the detector, the light diffracted by the second cell meets the light diffracted by the first, an interference term is produced which bears the desired product of g(t) and h(t). Since the two diffracted beams arrive from different angles, the desired result occurs on a spatial carrier of high frequency, which is stripped by passing through a holographic grating placed in the detector plane.

This almost-common-path design allows high bandwidth but suffers some practical problems. The high spatial frequency of the hologram imparts stringent mechanical stability requirements to the entire optical system. To block the undiffracted light from cell 15, a long optical path is required to form a plane where this light is disjoint from the desired contributions. The long path increases the stability problem. Also, because both the diffracted and undiffracted light from Bragg cell 14 must be carried through the system, the lenses must accommodate a larger range of angles and have larger apertures. In a system where geometric fidelity is critical, this stresses lens design.

SUMMARY OF THE INVENTION

The optical processor comprising my invention may be used to calculate the triple product integral operating on electrical signals. In particular, I have invented a triple product processor which accommodates large bandwidth signals without the severe stability requirements of the architectures in the prior art. Further, my invention requires fewer cylindrical lenses than other designs and uses one less modulator.

An object of my invention is to provide a triple product processor capable of performing triple product integrals on signals of large bandwidth.

It is also an object of my invention to provide a processor insensitive to vibrations and thermal gradients.

It is a further object of my invention to provide a processor which uses fewer cylinder lenses than processors in the prior art.

It is a still further object of my invention to provide a processor which minimizes the number of necessary acoustic modulators.

An apparatus having these and other desirable characteristics includes a light beam soruce, first means for temporally modulating said light beam with an electrical signal, second means for modulating said modulated light beam in one spatial dimension with a plurality of electrical signals, a two-dimensional time-integrating detector array, means for imaging said twice-modulated beam onto said detector array, and a shearing interferometer positioned before said detector to intercept, modify, and transmit said twice-modulated beam.

BRIEF DESCRIPTION OF THE DRAWINGS

My invention may be best understood when the specification which follows is read in conjunction with the drawings, in which.

DESCRIPTION OF THE PREFERRED EMBODIMENTS

Figure 1:
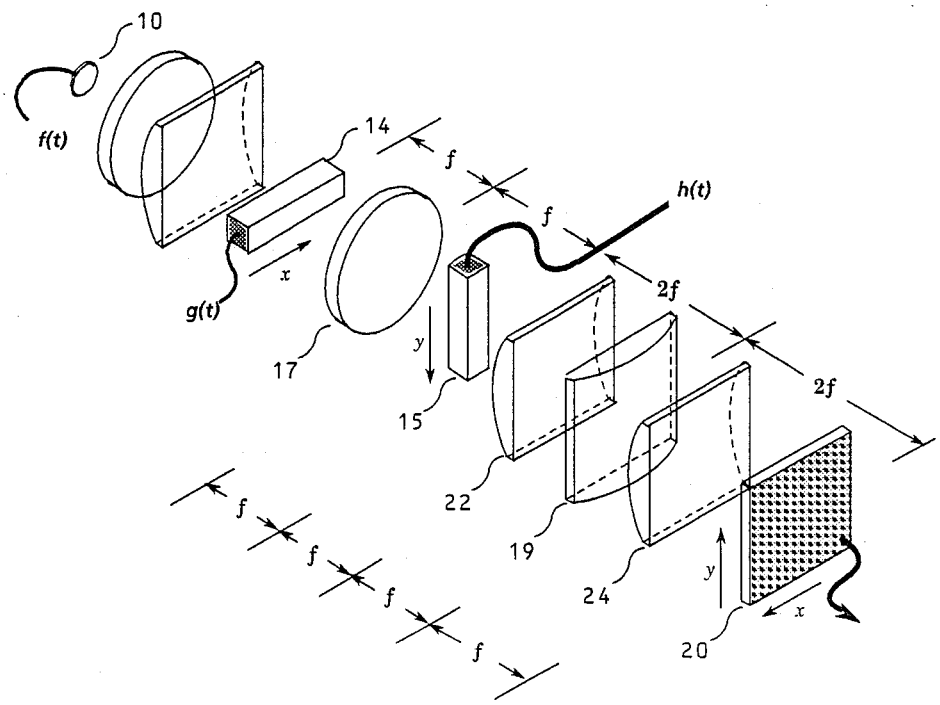
FIG. 1. PRIOR ART
FIG. 1 illustrates a prior art triple product processor, described above.
Figure 2:
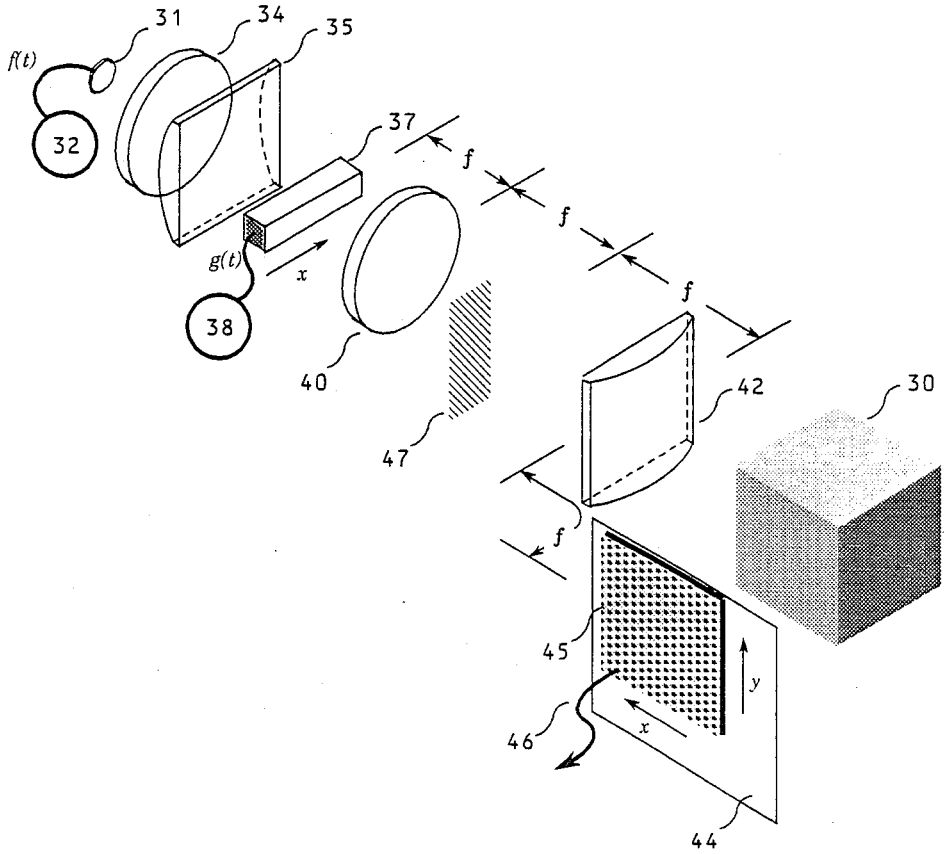
FIG. 2 illustrates a triple product processor embodying the principles of my invention.

The shearing interferometer triple product processor is diagrammed in FIG. 2. Without the interferometer 30, it is essentially a one-dimensional system. A light source 31, modulated by signal f from source 32, illuminates the system. The illumination might be provided, for example, by a laser or laser diode. While the preferred embodiment uses a coherent source, an incoherent source may be used instead. Also, the modulation may be internal to the source or may be provided by an external means. Lens 34 collimates the light which is then compressed vertically by cylinder lens 35 to enter the Bragg cell 37. Alternatively, other modulators which provide spatial modulation may be used. Cell 37 is driven by signal g from signal source 38. Lens 40 serves two functions: it collimates the light vertically and, together with cylinder lens 42, maps horizontal position in the plane of cell 37 to an output plane 44 containing detector array 45. Light undiffracted by cell 37 is blocked by spatial filter 47. Other imaging means may be substituted.

Figure 3:
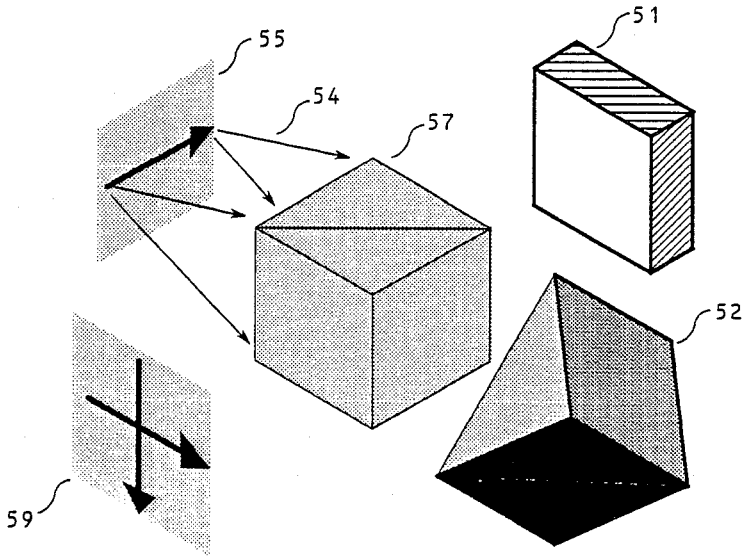
FIG. 3 illustrates an interferometer suitable for use in my invention.

On construction of the wavefront-reversing interferometer 30 is pictured in FIG. 3. It is a Michelson interferometer with a single mirror 51 in one leg and a roof prism (or pair of mirrors) 52 in the other. Light 54 entering the interferometer from object 55 is split by a cube beamsplitter 47, is reflected in both legs, and recombines in said beamsplitter before leaving to form object 59. The roof prism 52 serves to reflect the light about the diagonal. An image formed through the interferometer results in the superposition of two images—one the diagonal reflection of the other. It is important to note that this interferometer may be made very small and stable and could, in fact, be made from a single piece of glass.

Before reaching the output plane 44 (FIG. 2), light diffracted by the Bragg cell passes through the interferometer 30. Thus, two contributions are seen at the detector—one with horizontal position identifying delay in cell 37, and the other with vertical position doing so. The triple product will result from this interference, as described below.

Suppose that the acoustooptic cell is driven by $$g(t) = Re\ G(t)\ e^{j\Omega t},$$

where $\Omega$ is the cell center frequency and G(t) is the (complex) narrowband representation. Further, let the laser 31 have the intensity $f(t) \geqq 0$. With the interferometer 30 aligned such that light diffracted by the center frequency strikes the interferometer squarely, the light intensity seen in the detector plane is proportional to $$I(x,y,t) = f(t)|G(t-x)e^{j\Omega t} + G(t-y)e^{j\Omega t}|^2$$
$$= f(t)\{2ReG(t-x)G^*(t-y) + |G(t-x)|^2 + |G(t-y)|^2\}.$$

The detector elements integrate over a period T, producing the results $$C(x,y) = 2Re \int_T f(t)G(t-x)G^*(t-y)dt + B(x,y),$$

where $$B(x,y) = \int_T f(t)\{|G(t-x)|^2 + |G(t-y)|^2\}dt$$

is a bias term. (If necessary, the bias term may be calculated using a correlator and subtacted.) The term C above may be recognized as containing the triple product integral for the case where two inputs are the same.

As seen above, the use of this architecture has come at the expense of input generality: two of the three factors in the triple product integral are the same. One can regain the general operation at the expense of bandwidth or time delay range. Three schemes for doing this—one employing frequency division multiplexing, one using time division multiplexing, and a third exploiting space multiplexing—are discussed below. In each case, the functions F(t), G(t), and H(t) are given and the integrals $$\{R(x,y) = \int_T F(t)G(t-x)H(t-y)dt, (x,y)\epsilon S\}$$

are to be evaluated.

For the frequency multiplexing technique, signal source 38 (FIG. 2) is modified so that the Bragg cell is driven by $$g(t)=Re\,[G(t)e^{j(\Omega-\omega/2)t}+H(t)e^{j(\Omega+\omega/2)t}],$$

where $\Omega$ is the cell center frequency and $\omega$ is chosen by criteria to be stated shortly. The laser is given the intensity $$f(t)=b+Re\,F(t)e^{j\omega t}.$$

by modifying signal source 32. In general, F(t), G(t), and H(t) are complex.

Figure 4:
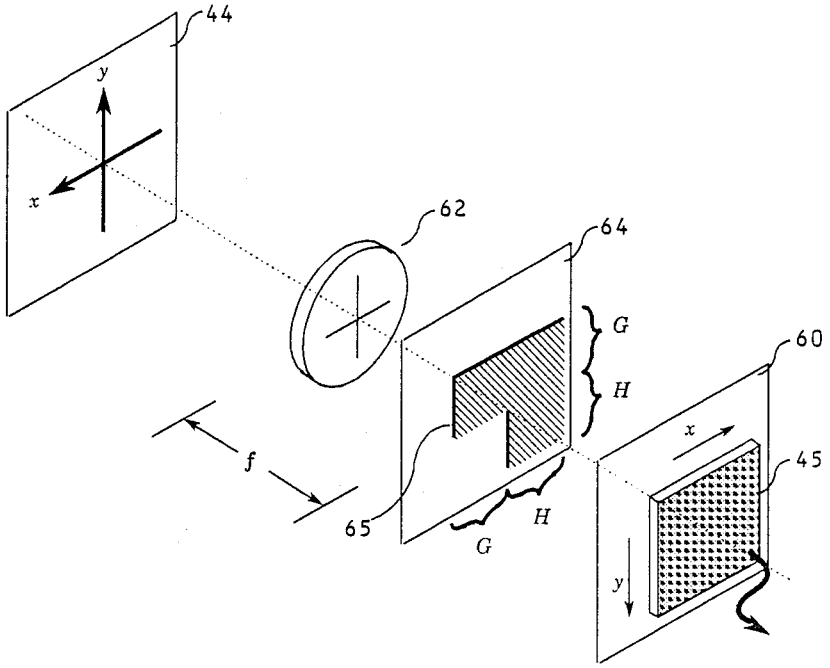
FIG. 4 illustrates spatial filtering for frequency division multiplexing to generalize the triple product processor.

Now suppose that F(t), G(t), and H(t) have (angular) frequencies confined to the range $(-2\pi B, 2\pi B)$. If $\omega$ is chosen so that $\omega > 4\pi B$, then G(t) and H(t) will contribute disjoint frequencies to g(t). This fact may be exploited to separate the contributions from G(t) and H(t) onto separate axes, as required for the general operation. Apparatus to perform this separation is illustrated in FIG. 4. The time-integrating detector array 45 is moved from its location in plane 44 to a new plane 60. A lens 62 receives the light from plane 44 and images this light onto plane 60. Between lens 62 and plane 60 a Fourier transfrom plane 64 forms. In this plane, the contributions from G(t) and H(t) are spatially separated for each dimension. Thus, G(t) may be identified with the x dimension and H(t) with the y dimension by blocking all but one quadrant by mask 65.

With the mask in place, the intensity seen at detector 45 is $$I(x,y,t)=[b+Re\,F(t)e^{j\omega t}][|G(t-x)|^2+|H(t-y)|^2+2ReG(t-x)H^*(t-y)e^{-j\omega t}e^{j\omega(x+y)/2}].$$

When the intensity is integrated over time by the detector, only those terms in the intensity having temporal frequencies in the neighborhood of zero will contribute. It is now clear why the input F(t) was placed on a carrier of frequency $\omega$: the desired interference term occurs on a temporal carrier of this frequency, and must be "beat" down to zero.

With the choice $\omega > 4\pi B$, the detector produces the results $$D(x,y)=U_1(x,y)+U_2(x,y)+Re\,e^{j\omega(x+y)/2}R(x,y),$$

where $$R(x,y) = \int_T F(t)G(t-x)H^*(t-y)dt$$

is the required triple product integral, and $$U_1(x,y) = b\int_T [|G(t-x)|^2 + |H(t-y)|^2]dt$$

and $$U_2(x,y) = Re\int_T F(t)e^{j\omega t}[|G(t-x)|^2 + |H(t-y)|^2]dt$$

are undesired. Notice that the desired term is present on a spatial carrier and has spatial frequencies which are disjoint with those of the undesired contributions. Hence, by multiplying the outputs by cos $[\omega(x+y)/2]$ and sin $[\omega(x+y)/2]$ and low-pass filtering, the real and imaginary portions of R(x,y) may be extracted, respectively, if desired. Removal of the spatial carrier in this architecture is much more practical than in the common-path design cited above because the carrier frequency is substantially less here.

The technique described above allows one to implement the general triple product integral with only minor modification of the simple optical system. This comes at the expense of halving the available bandwidth and doubling the required number of detector pixels in each direction. A similar loss in signal bandwidth and detector resolution is encountered when the incoherent-light TPP is made to produce the general triple product integral by introduction of reference tones. Also, three quarters of the light is lost due to the mask. Two additional benefits of this process are that the bias is removed and that the entire complex value of R(x,y) may be obtained.

The generalization may also be achieved through time division multiplexing, with similar performance tradeoffs. In this scheme, source 38 (FIG. 2) is modified so that alternate samples of H(t) and G(t) are used to modulate the Bragg cell 37. By changing signal source 32, the laser 31 is pulsed at half of this sample rate with each pulse weighted by $F(t) \geqq 0$. The result is that alternate positions on the cell correspond to contributions from G(t) and H(t), respectively. By looking at the proper locations on the output plane, the general triple product may be seen. Again, in order not to lose information from this sampling process, the modulator bandwidth must be twice as wide as the signal bandwidth. Despite the fact that only one fourth of the points on the output plane are wanted, detector pixels need not be wasted, since masking due to detector geometry or due to an external mask may be used to sample the desired positions efficiently.

Figure 5:
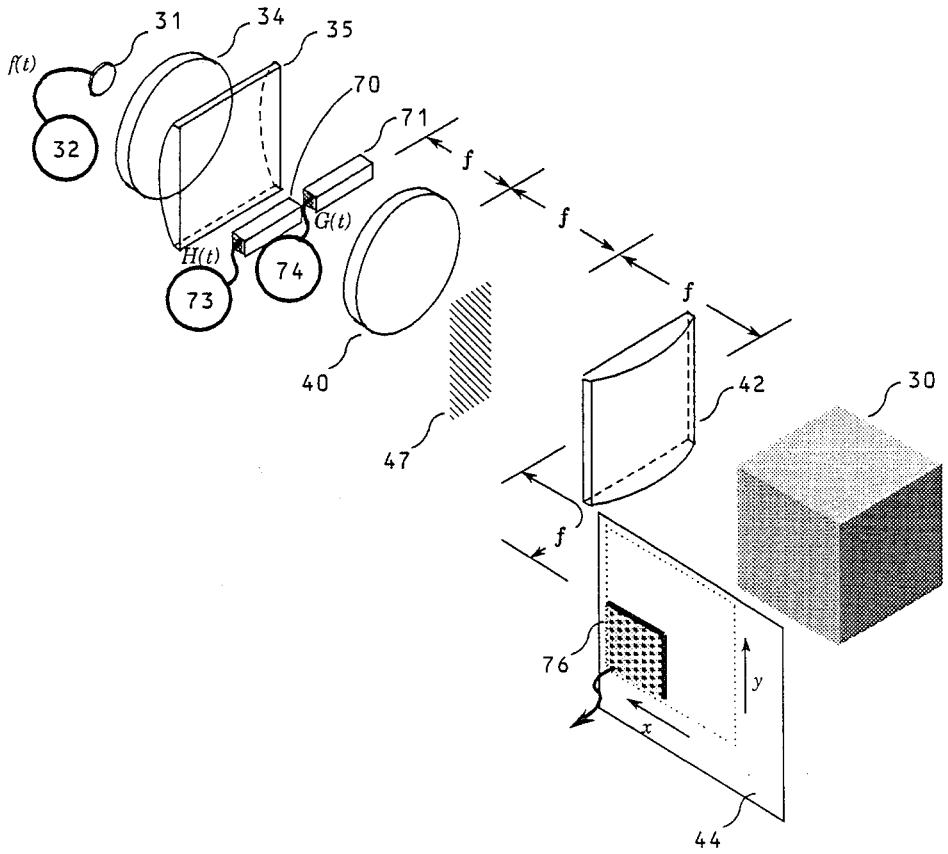
FIG. 5 illustrates the use of two modulators for space division multiplexing to generalize the triple product processor.

A third embodiment for generalizing my invention to accommodate three different inputs is illustrated in FIG. 5. This figure shows the TPP with two modifications. The first is that Bragg cell 37 (FIG.2) and its signal source is replaced by two collinear Bragg cells 70 and 71 driven by signal sources 73 and 74, respectively. These sources provide the signals H(t) and G(t), respectively. The effect of this modification is that the output plane 44 now has four quadrants bearing interference from the combinations H with H, G with G, G with H, and H with G. The second modification is that detector array 45 (FIG. 2) is replaced by a smaller array 76 that only receives one of the aforementioned quadrants of light transmitted by interferometer 30. In this quadrant, the detector elements integrate over a period T, producing the results $$C(x,y) = 2Re \int_T f(t)G(t-x)H^*(t-y)dt + B(x,y),$$

where $$B(x,y) = \int_T f(t)\{|G(t-x)|^2 + |H(t-y)|^2\}dt$$

is a bias term. The first term of C is recognized as the general triple product integral.

I claim:

1. An optical processor apparatus for calculating the triple product integral operating on electrical signals, comprising:

a light beam source;

first means for temporally modulating said light beam with an electrical signal;

second means for modulating said modulated light beam along an axis with a plurality of electrical signals, wherein spatial position along said axis corresponds to time delay of said plurality of signals;

a planar time-integrating detector array having orthogonal axes;

means for imaging said twice-modulated beam onto said detector array, and means positioned between said imaging means and said array for splitting said twice-modulated beam and for reflecting two superimposed contributions of said twice modulated beam onto said detector, one with said time delay mapped onto a first of said orthogonal axes and one with said time delay mapped onto the second of said orthogonal axes.

2. The processor of claim 1, wherein said light source and first modulating means comprise an internally modulated light source.

3. The processor of claim 1, wherein said light source is a laser diode.

4. The processor of claim 1, wherein said second modulation means is an acoustooptic modulator.

5. The processor of claim 1, wherein said beam splitting and reflecting means is a wavefront-reversing shearing interferometer.

6. The processor of claim 1, wherein said plurality of electrical signals comprises a plurality of multiplexed signals.

7. The processor of claim 1, wherein said second modulation means comprises a plurality of collinear acoustooptic modulators.

8. An optical processor apparatus for calculating the triple product integral operating on electrical signals, comprising:

a light beam source;

first means for temporally modulating said light beam with an electrical signal;

second means for modulating said modulated light beam along an axis with a plurality of electrical signals, wherein spatial position along said axis corresponds to time delay of said plurality of signals;

a planar time-integrating detector array having orthogonal axes;

means for imaging said twice-modulated beam onto said detector array;

means positioned between said imaging means and said array for splitting said twice-modulated beam and for reflecting two superimposed contributions of said twice modulated beam onto said detector, one with said time delay mapped onto a first of said orthogonal axes and one with said time delay mapped onto the second of said orthogonal axes;

means for producing an intermediate Fourier transform plane between said splitting and reflecting means and said detector array, and a transform mask placed in said transform plane.

9. The processor of claim 8, wherein said light source and first modulating means comprise an internally modulated light source.

10. The processor of claim 8, wherein said light source is a laser diode.

11. The processor of claim 8, wherein said second modulation means is an acoustooptic modulator.

12. The processor of claim 8, wherein said beam splitting and reflecting means is a wavefront-reversing shearing interferometer.

13. The processor of claim 8, wherein said plurality of electrical signals comprises a plurality of multiplexed signals.

14. The processor of claim 8, wherein said second modulation means comprises a plurality of collinear acoustooptic modulators.

* * * * *